US008857740B2

(12) United States Patent
Wurz

(10) Patent No.: US 8,857,740 B2
(45) Date of Patent: Oct. 14, 2014

(54) TWO-COMPONENT NOZZLE WITH SECONDARY AIR NOZZLES ARRANGED IN CIRCULAR FORM

(76) Inventor: Dieter Wurz, Baden-Baden (DE)

( * ) Notice: Subject to any disclaimer, the term of this patent is extended or adjusted under 35 U.S.C. 154(b) by 1147 days.

(21) Appl. No.: 12/224,027

(22) PCT Filed: Feb. 17, 2007

(86) PCT No.: PCT/EP2007/001384

§ 371 (c)(1),
(2), (4) Date: Aug. 14, 2008

(87) PCT Pub. No.: WO2007/098865

PCT Pub. Date: Sep. 7, 2007

(65) Prior Publication Data

US 2010/0163647 A1 Jul. 1, 2010

(30) Foreign Application Priority Data

Feb. 24, 2006 (DE) ..... 10 2006 009 147

(51) Int. Cl.
*B05B 7/10* (2006.01)
*B05B 7/04* (2006.01)
*B05B 7/06* (2006.01)

(52) U.S. Cl.
CPC ..... *B05B 7/10* (2013.01); *B05B 7/0458* (2013.01); *B05B 7/066* (2013.01)
USPC ..... 239/406; 239/405; 239/419; 239/419.3; 239/424; 239/474; 239/489

(58) Field of Classification Search
USPC ..... 239/418–419.3, 423–424.5, 474, 475, 239/487, 489, 399, 400, 403, 405, 406
See application file for complete search history.

(56) References Cited

U.S. PATENT DOCUMENTS

| | | | | | |
|---|---|---|---|---|---|
| 733,463 | A | * | 7/1903 | Dennison | 431/163 |
| 733,579 | A | * | 7/1903 | Fitton | 239/424 |
| 1,451,063 | A | | 4/1923 | Anthony | |
| 3,272,441 | A | * | 9/1966 | Davis, Sr. | 239/403 |
| 3,642,202 | A | * | 2/1972 | Angelo | 239/8 |
| 4,203,717 | A | * | 5/1980 | Facco et al. | 431/182 |
| 4,338,099 | A | * | 7/1982 | Crouch et al. | 48/197 R |
| 4,341,347 | A | * | 7/1982 | DeVittorio | 239/3 |
| 4,946,475 | A | | 8/1990 | Lipp et al. | |
| 5,188,296 | A | * | 2/1993 | Duez et al. | 239/403 |
| 2004/0056124 | A1 | | 3/2004 | Haruch | |

FOREIGN PATENT DOCUMENTS

| | | | |
|---|---|---|---|
| DE | 10 2005 048 489 | A1 | 4/2007 |
| DE | 10 2006 001319 | A1 | 7/2007 |
| EP | 0 205 739 | A1 | 12/1986 |
| EP | 1 364 745 | A2 | 11/2003 |
| WO | WO 2007/080084 | A1 | 7/2007 |

* cited by examiner

*Primary Examiner* — Christopher Kim
(74) *Attorney, Agent, or Firm* — Flynn, Thiel, Boutell & Tanis, P.C.

(57) ABSTRACT

A two-fluid nozzle is provided. The two-fluid nozzle includes a main nozzle, a mixing chamber and a nozzle orifice connected to the mixing chamber and positioned downstream of the mixing chamber. A ring of secondary air nozzles surrounding the nozzle orifice is also provided.

25 Claims, 6 Drawing Sheets

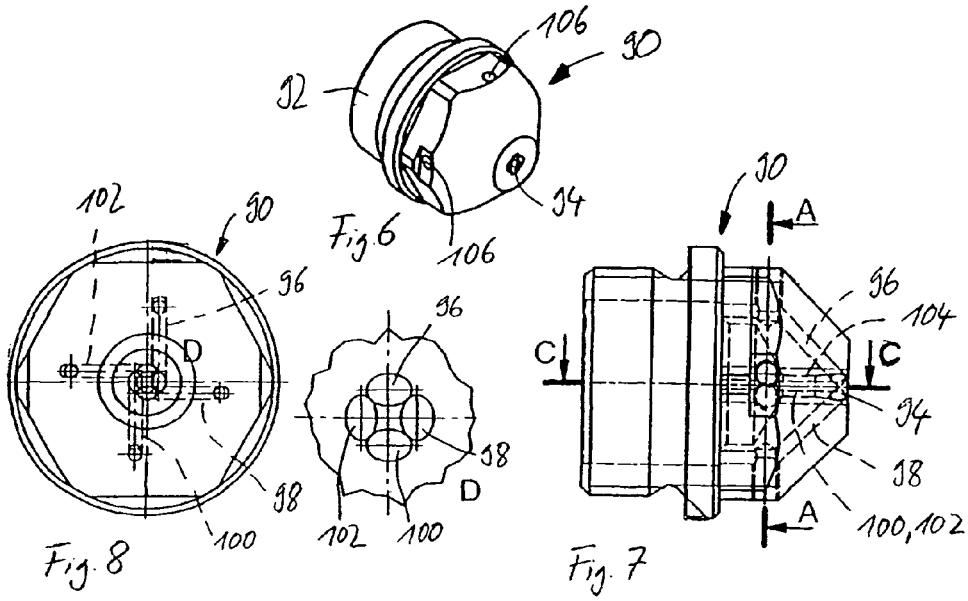
A-A
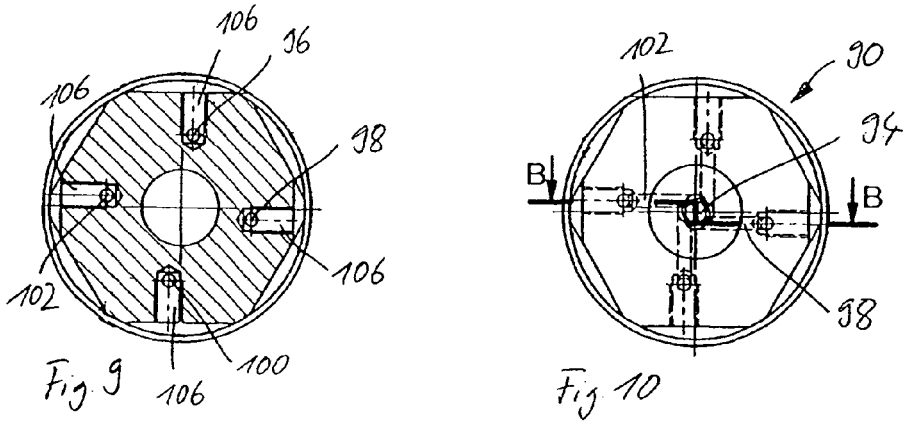
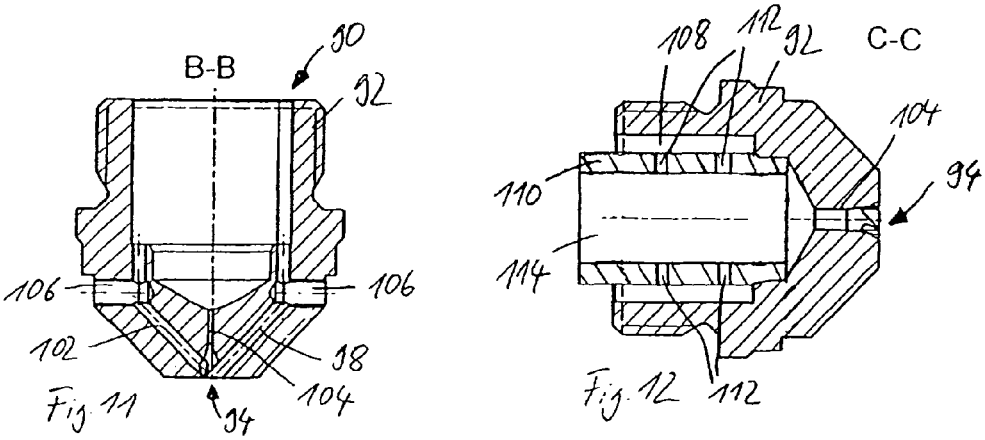

TWO-COMPONENT NOZZLE WITH SECONDARY AIR NOZZLES ARRANGED IN CIRCULAR FORM

FIELD OF THE INVENTION

The invention relates to a two-fluid nozzle with a main nozzle, a mixing chamber and a nozzle orifice connected to the mixing chamber and positioned downstream of the mixing chamber.

BACKGROUND OF THE INVENTION

Liquids are dispersed in a gas in many process engineering installations. It is often of decisive importance for the liquid to be sprayed in the form of very fine droplets. The finer the droplets, the greater the specific droplet surface, which can lead to significant process engineering advantages. Thus, e.g. the size of a reaction vessel and its manufacturing costs are significantly dependent on the average droplet size. However, in many cases it is not adequate for the average droplet size to drop below a specific limit value. Considerable operating problems can in fact arise with a few significantly larger droplets. This is particularly the case if, as a result of their size, the droplets do not evaporate quickly enough, so that droplets or also pasty particles are deposited in subsequent components, e.g. on fabric filter bags or on fan blades and can lead to operating problems caused by incrustations or corrosion.

In order to finely spray liquids, use must be made either of high pressure single-fluid nozzles or medium pressure two-fluid nozzles. An advantage of two-fluid nozzles is that they have relatively large flow cross-sections, so that large particle-containing liquids can also be sprayed.

FIG. 1 shows in exemplified manner a prior art two-fluid nozzle 3 substantially symmetrical to axis 24. The liquid 1 to be sprayed is introduced into the mixing chamber 7 via a central lance tube 2 at the bottleneck 10. The pressure gas 15 is supplied by means of an external lance tube 4 to an annular chamber 6 surrounding in annular manner the mixing chamber 7. The pressure gas is introduced into the mixing chamber 7 by means of a certain number of holes 5. A first dispersion of the liquid in droplet form takes place in the mixing chamber 7, so that here a droplet-containing gas 9 is formed. There is also a bottleneck 14 at the exit from the mixing chamber 7. To the bottleneck 14 is connected a divergent exit 26, which terminates with the nozzle orifice 8. The droplet-containing gas flow 9 formed in the mixing chamber 7 is highly accelerated in the convergent-divergent or Laval nozzle, so that here a further droplet dispersion is brought about.

Two-fluid nozzles with a single exit hole of a conventional construction suffer from the fact that the jet 21 of droplets and atomization air passing out of the nozzle only has a limited opening or aperture angle $\alpha$, so that relatively large distances or large containers are required for droplet evaporation.

In the case of such nozzles a fundamental problem arises due to the walls in the mixing chamber 7 being wetted with liquid. The liquid wetting the wall in the mixing chamber 7 is driven towards the nozzle orifice 8 as a liquid film by the shear and compressive stresses. An attempt is made to accept that the walls towards the nozzle orifice 8 are blown dry due to the high flow rates of the gas phase and that only very fine droplets are formed from the liquid film.

However, theoretical and experimental work carried out by the inventor has shown that liquid films can still exist on walls in stable film form without droplet formation if the gas flow driving the liquid film towards the nozzle orifice 8 achieves supersonic speed. This is the reason why it is possible to use a liquid film cooling in rocket thrust nozzles. The film flow is particularly critical when spraying high viscosity liquids, which simultaneously have a high surface tension, e.g. glycol in cryogenic dryers of natural gas pumping stations or solid suspensions in spray absorbers.

The liquid films driven by the gas flow to the nozzle orifice 8 can, as a result of adhesiveness, even migrate around a sharp edge at the nozzle orifice 8 and then form on the outside of the nozzle orifice 8 a water bulge 12. From the water bulge 12 are detached marginal droplets 13, whose diameter is a multiple of the average droplet diameter in the jet core. Although these large marginal droplets only contribute a small mass proportion to the droplet load, they are still determinative for the container dimensions, in which the temperature of a gas is to be lowered by evaporation cooling from 350° C. to 120° C., without there being an introduction of droplets into downstream components such as a fan or fabric filter.

The not previously published German patent application DE 10 2005 048 489.1 of the same inventor relates to a two-fluid nozzle, in which the formation of large marginal droplets is reliably prevented by annular clearance atomization. The content of the patent application is fully included by reference in the present application. FIG. 2 shows a corresponding two-fluid nozzle with annular clearance atomization. In the case of the variant shown the annular clearance air, also referred to as secondary air, is branched off directly from the annular chamber 6 via holes 19. However, this nozzle type also suffers from the property of producing a relatively slender jet 21 with an opening angle $\alpha$ of approximately 15°. It is known that such nozzles can fundamentally be surrounded by a screen or barrier air ring 25 and a screen or barrier air nozzle 23. The essential difference between barrier air 11 and annular clearance air is that the total pressure of the annular clearance air leaving the annular clearance 16 coincides from the order of magnitude standpoint with the pressure of the pressure gas 15 for atomization, whereas the pressure of the barrier air 11 is generally one or two orders of magnitude lower.

The pressure gas leaves the annular clearance 16 with a high velocity and ensures that a liquid film on the wall of the nozzle orifice 8, particularly of the divergent exit section, is drawn out to a very thin liquid lamella, which then is broken down into small droplets. This prevents or reduces to a tolerable level the formation of large droplets from wall liquid films in the nozzle exit area and at the same time the fine droplet spectrum in the jet core can be maintained without it being necessary for this purpose to increase the pressure gas consumption of the two-fluid nozzle or the energy requirements linked therewith. The annular clearance air quantity can e.g. be 10 to 40% of the total atomization air quantity. The total pressure of the air in the annular clearance is advantageously 1.5 to 2.5 bar absolute. The total pressure of the air in the annular clearance is advantageously so high that on expansion to the pressure level in the container the speed of sound is roughly reached. The exit opening is formed by a circumferential wall, whose outermost end forms an exit edge and the annular clearance is located in the vicinity of the exit edge. Appropriately the annular clearance is formed between the exit edge and an outer annular clearance wall. Considered in the outflow direction, the annular clearance wall edge is positioned downstream of the exit edge. Advantageously the annular clearance wall edge is positioned downstream of the exit edge by 5 to 20% of the exit opening diameter. A pressure of the pressure gas supplied to the annular clearance and a pressure of the pressure gas issuing through the pressure gas inlet into the mixing chamber 7 can be adjusted independently of one another. The inlet openings 5 into the mixing chamber 7 can be oriented tangentially to a circle about the nozzle median longitudinal axis, in order to produce an angular momentum in a first direction. Several inlet openings can be provided spaced from one another and different inlet openings can be so tangentially oriented that they produce an angular momentum in different directions, e.g. also opposing angular momentum directions.

By reference the content of the not previously published patent application DE 10 2006 001 319.0 is also completely included in the present application. Patent application DE 10 2006 001 319.0 describes a two-fluid nozzle for wall-bound installation, in which in order to avoid wall coatings an envelope, barrier or screen air nozzle and the wall area around the nozzle are heated. Otherwise the nozzle described therein is identical to the two-fluid nozzle according to DE 10 2005 048 489.1.

It is common to all the above-described two-fluid nozzles that the opening angle of a spray jet produced is comparatively small, so that long distances are required for droplet evaporation.

The present invention provides a two-fluid nozzle with which it is possible to obtain a large spray jet opening angle.

For this purpose, according to the invention a two-fluid nozzle is provided having a main nozzle, a mixing chamber and a nozzle orifice connected to the mixing chamber and positioned downstream thereof, in which secondary air nozzles issue in an annular manner in the vicinity of the nozzle orifice.

Through the provision of a ring of secondary air nozzles positioned in the vicinity of the nozzle orifice or also surrounding the nozzle orifice it is possible to produce a nozzle jet with a much greater opening angle $\alpha$ of at least approximately 30° to 45°. Compressed air jets passing out of the secondary air nozzles act on the jet of droplets and atomization air passing out of the nozzle and widen the same. At the same time and without a continuous annular clearance it is possible to retain the advantages of annular clearance atomization according to German patent application DE 10 2005 048 489.1 and specifically the formation of large marginal droplets is prevented.

Therefore the inventive nozzle results from a two-fluid nozzle with an annular clearance atomization according to the not previously published German patent application DE 10 2005 048 489.1, in that the annular clearance for annular clearance atomization is replaced by a ring of individual air nozzles which surround the nozzle orifice. Surrounding is here intended to mean that the individual secondary air nozzles are arranged in a circular manner around the nozzle orifice and that in the case of several secondary air nozzles their exit jets are in contact or even are superimposed in the vicinity of the nozzle orifice, so that a continuous annular secondary air jet surrounds the nozzle orifice. The imaginary projections of the secondary air holes in the plane of the nozzle orifice can be superimposed to a closed, annular surface. Thus, individual secondary air nozzle holes start in the comparatively wide annulus outside the mixing chamber, but during the further travel in the direction of the nozzle orifice can be in contact with each other or even overlap at the position of the latter. Besides the already discussed overlap of the projections of the extensions of the nozzle holes on the plane of the nozzle orifice it is naturally also possible to introduce secondary air holes that they are already superimposed in the vicinity of the exit and in the vicinity of the nozzle orifice, so that the nozzle orifice wall has an annular, circumferential recess. Thus, the inventive nozzle offers the possibility, as a function of the diameter or arrangement of the secondary air holes, of providing an annular clearance with a variable width. This is particularly important when manufacturing nozzle series or families if use is to be made of the same body with different annular clearance widths. Thus, the inventive nozzle can have a geometrical overlap of the secondary air holes in the vicinity of the nozzle orifice, and the overlap occurs either in the nozzle orifice wall area or only on an imaginary plane level at the height of the nozzle orifice. However, in addition to the secondary air nozzles, it is also possible to have an annular clearance atomization. Through the provision of annularly arranged secondary air nozzles, as a result of a redesign in the vicinity of the nozzle orifice, a two-fluid nozzle with internal mixing can be transformed into a nozzle with a wide angle jet.

According to a further development of the invention a main spraying direction of the secondary air nozzles is oriented into a main spray jet emanating from the nozzle orifice.

As a result of such a secondary air nozzle orientation, entry takes place into the main nozzle spray jet so as to widen the same.

According to a further development of the invention the median longitudinal axes of the secondary air nozzles are arranged under an angle $\beta$ of 20° to 80° to a median longitudinal axis of the main nozzle.

Thus, the spray jet of the secondary air nozzles receives both a component parallel to the median longitudinal axis of the main nozzle and also a component perpendicular thereto and which is mainly responsible for widening the spray jet. Different widenings of the spray jet can be obtained by varying the angle $\beta$.

According to a further development of the invention the median longitudinal axis of the secondary air nozzles do not intersect the median longitudinal axis of the main nozzle.

As a result of a skewed arrangement of the median longitudinal axes of the secondary air nozzles it is possible to bring about a particularly uniform spray jet widening. With a corresponding arrangement of the secondary air nozzles an angular momentum can e.g. be impressed on the main nozzle spray jet which aids a widening of the jet.

In a further development of the invention the secondary air nozzles are oriented tangentially to an imaginary circle concentric to the median longitudinal axis of the main nozzle.

This makes it possible to obtain a very effective spray jet widening with fine droplet atomization. Considered in the direction of the median longitudinal axis of the main nozzle, the median longitudinal axes of the secondary air nozzles appear as tangents, which engage on an imaginary circle concentrically surrounding the main nozzle median longitudinal axis. As the secondary air nozzles also form an angle of less than 90° with the main nozzle median longitudinal axis, they are consequently in contact with an imaginary circular cylinder concentrically surrounding the main nozzle median longitudinal axis. Advantageously the imaginary circle has a radius between 30 and 80% of the radius of the main nozzle spray jet level with the circle. Such an orientation of the secondary air nozzles leads to a significant widening of the spray jet in the case of fine droplet atomization. On considering the imaginary circle with which there is tangential engagement of the projection of the median longitudinal axes of the secondary air nozzles and specifically the plane in which the circle is located, the plane forms with the outer border of the main spray jet a circular intersection with a spray jet radius. The imaginary circle then has a radius which is between 30 and 80% of the spray jet radius. Advantageously the imaginary circle is positioned downstream of the main nozzle orifice. The contacting of the median longitudinal axes of the secondary air nozzles consequently takes place on an imaginary circular cylinder around the main nozzle median longitudinal axis downstream of the nozzle orifice.

In a further development of the invention the secondary air nozzles open out or issue upstream of the main nozzle orifice into the outflow channel from the mixing chamber to the nozzle orifice.

It has proved advantageous if the secondary air nozzles open out or issue into the outflow channel directly upstream of the nozzle orifice. It can be advantageous for the orifices of the secondary air nozzles to contact or partly overlap at the entrance into the outflow channel.

In a further development of the invention there is a separate supply air line to the secondary air nozzles.

In this way the air quantity and the velocity of the air leaving the secondary air nozzles can be separately adjusted and e.g. used for setting a desired spray jet angle. For this purpose adjusting means are then required for adjusting the air pressure at the secondary air nozzles.

According to a further development of the invention the secondary air nozzles are in flow connection with a pressure gas supply line, which is also in flow connection with the mixing chamber.

A simple construction of the inventive nozzle is obtained if the air required for the secondary air nozzles is branched from the main nozzle pressure gas supply line. To this end, the secondary air nozzles can be connected to an annulus surrounding the mixing chamber. As a result the inventive two-fluid nozzle can have a very compact construction.

According to the invention the nozzle orifice is surrounded by an annular clearance, compressed air being supplied to the annular clearance.

Through the provision of such an additional annular clearance atomization water droplets at the nozzle orifice emanating from a liquid film covering the outflow channel wall can be drawn out to form liquid lamellas and atomized in fine droplet form. An additional annular clearance atomization can then be particularly advantageous if the individual secondary air nozzles are not in contact or overlap at the edge of the outflow channel.

According to a further development of the invention, starting from the mixing chamber, an outflow channel initially continuously narrows and then, starting from a bottleneck in the outflow chamber, then continuously widens towards the nozzle orifice.

As a result the two-fluid mixture passed through the outflow channel is highly accelerated in the convergent-divergent-nozzle and a fine droplet distribution in the spray jet can be obtained. The outflow channel can be so designed and the pressure of the liquid and pressure gas so adjusted that at least zonally supersonic speed is reached in the outflow channel.

According to a further development of the invention an additional screen air nozzle annularly surrounding the nozzle orifice is provided.

Such a screen or envelope air nozzle can be provided in addition to the annular clearance for annular clearance atomization and is supplied with screen air at a lower pressure than is required for annular clearance atomization.

Further features and advantages of the invention can be gathered from the claims, the following description and the drawings. Individual features of the different embodiments of the invention shown in the drawings can be randomly combined without passing beyond the scope of the invention. In particular, the features of the two-fluid nozzle shown in FIG. 2 can be randomly combined with the nozzles shown in FIGS. 3, 4 and 5 without passing beyond the scope of the invention.

BRIEF DESCRIPTION OF THE DRAWINGS

FIGS. 6 to 12 show different views of a third embodiment of an inventive two-fluid nozzle;

DETAILED DESCRIPTION

Figure 1:
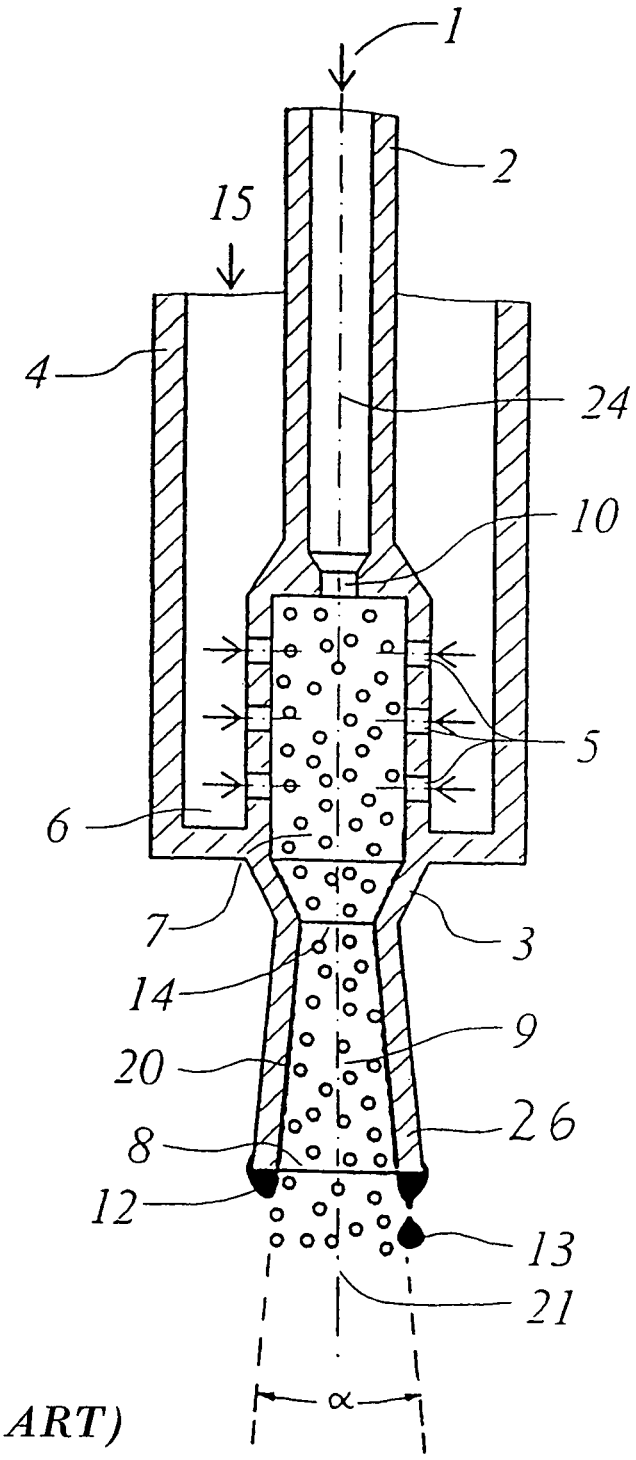
Fig. 1 (PRIOR ART)
FIG. 1 shows a prior art two-fluid nozzle.
Figure 2:
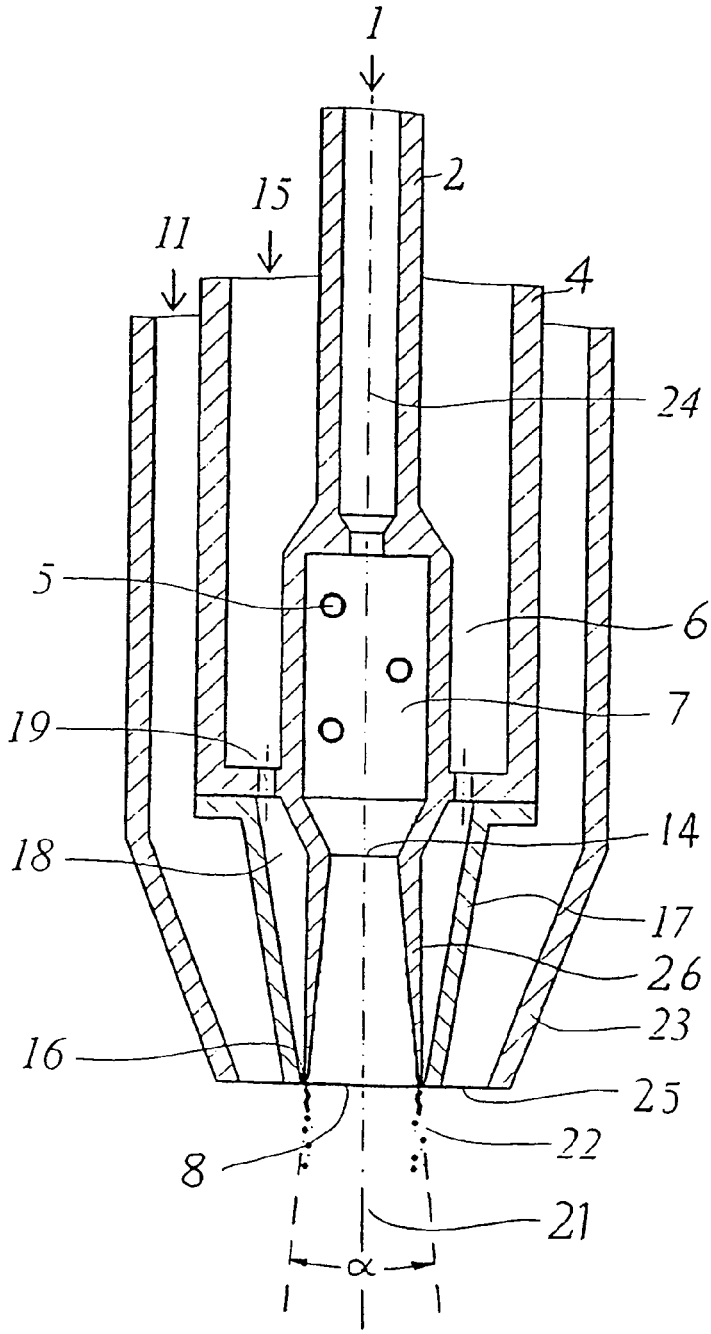
FIG. 2 shows a two-fluid nozzle with annular clearance atomization and screen air nozzle according to the not previously published application DE 10 2005 048 489.1.
Figure 3:
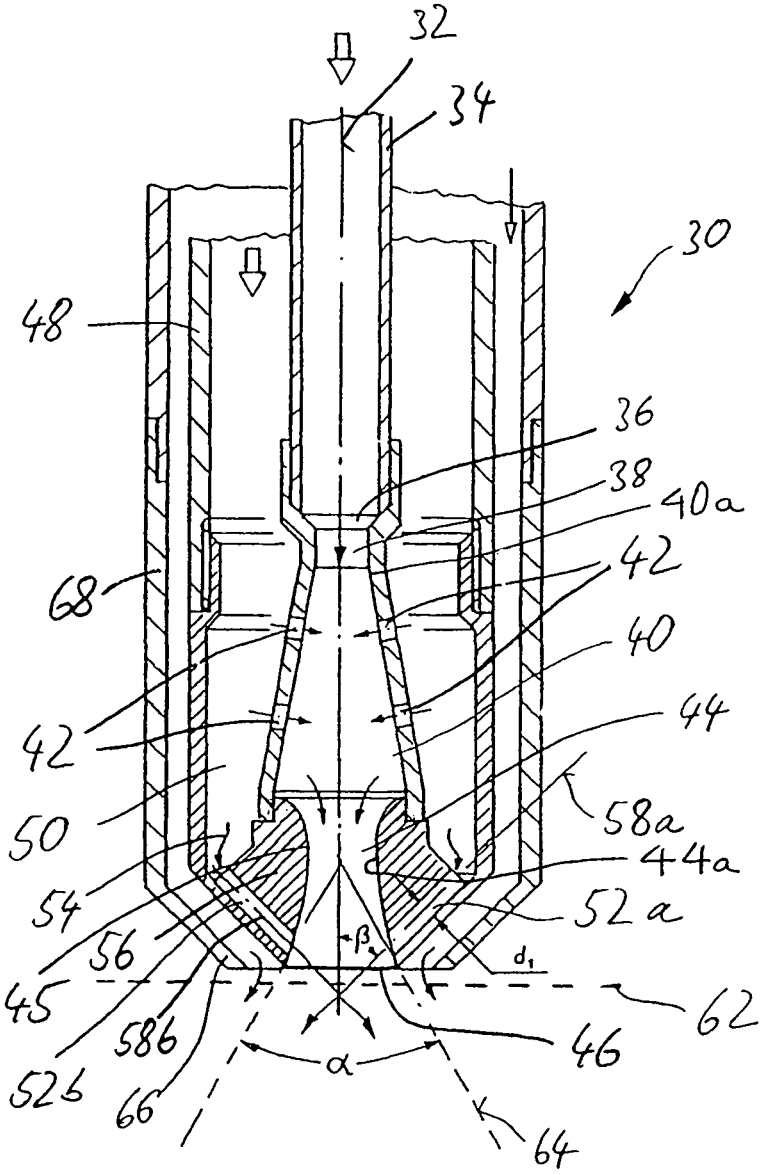
FIG. 3 shows a first embodiment of an inventive two-fluid nozzle.

The sectional view of FIG. 3 shows an inventive two-fluid nozzle 30 having a feed tube 34 for the liquid to be sprayed arranged concentrically to a median longitudinal axis 32 of the nozzle 30. The feed tube 34 passes into a truncated cone-shaped constriction 36 and then into a cylindrical bottleneck 38 to which is connected a truncated cone-shaped widening mixing chamber 40. A circumferential wall 40*a* of the mixing chamber 40 is provided with pressure gas inlets 42. The inlets 42 are located in two rings spaced along the outflow direction in the wall of the mixing chamber 40. The mixing chamber 40 is connected to an outflow channel 44 defining a main nozzle 44*a* and terminating at a nozzle orifice 46 and which initially continuously narrows and then, starting from a bottleneck 45, continuously widens again. In the sectional view of FIG. 3 the border of the outflow channel 44 has a continuous curved shape. The mixture of gas and liquid, e.g. air and water formed in the mixing chamber 40 is highly accelerated in the outflow channel 44 and can reach supersonic speed in the divergent section.

Pressure gas is supplied to the two-fluid nozzle 30 via a pressure gas tube 48 concentrically surrounding the feed tube 34. The pressure gas is consequently guided in the annular area between the feed tube 34 and the pressure gas tube 48. Starting from an annulus surrounding the mixing chamber 40, the pressure gas then passes through the inlets 42 into the mixing chamber 40. At the downstream end of an annulus 50 are provided inlets for secondary air nozzles 52*a*, 52*b* into which the pressure gas passes according to the arrows 54 of FIG. 3. The secondary air nozzles 52 are in the form of holes in a closing part 56, which centrally carries the outflow channel 44 and provides at the upstream end of the outflow channel 44 a flange for receiving a tubular component defining the mixing chamber 40. The annulus 50 for the pressure gas is also formed by component 56 and to its upstream end is screwed the component 56 with pressure gas tube 48.

The secondary air nozzles 52*a*, 52*b* have median longitudinal axes 58*a*, 58*b*, which form an angle β with the median longitudinal axis 32 of the main nozzle 44*a*, defined by the outflow channel 44. In FIG. 3 the angle β is approximately 45° and can be between approximately 20° and approximately 80°. The secondary air nozzles 52*a*, 52*b* issue into the outflow channel 44 directly upstream of the nozzle orifice 46. The median longitudinal axes 58*a*, 58*b* of the two secondary air nozzles 52*a*, 52*b* intersect downstream of the nozzle orifice 46 with the median longitudinal axis 32.

There is also an envelope air nozzle 66, formed by means of an envelope air tube 68, which annularly surrounds the nozzle orifice 46. By means of the envelope air tube 68 there is a supply of pressure gas with a lower pressure than the pressure gas supply to the mixing chamber 40. The envelope air surrounds the spray jet 64 in annular manner.

Figure 4:
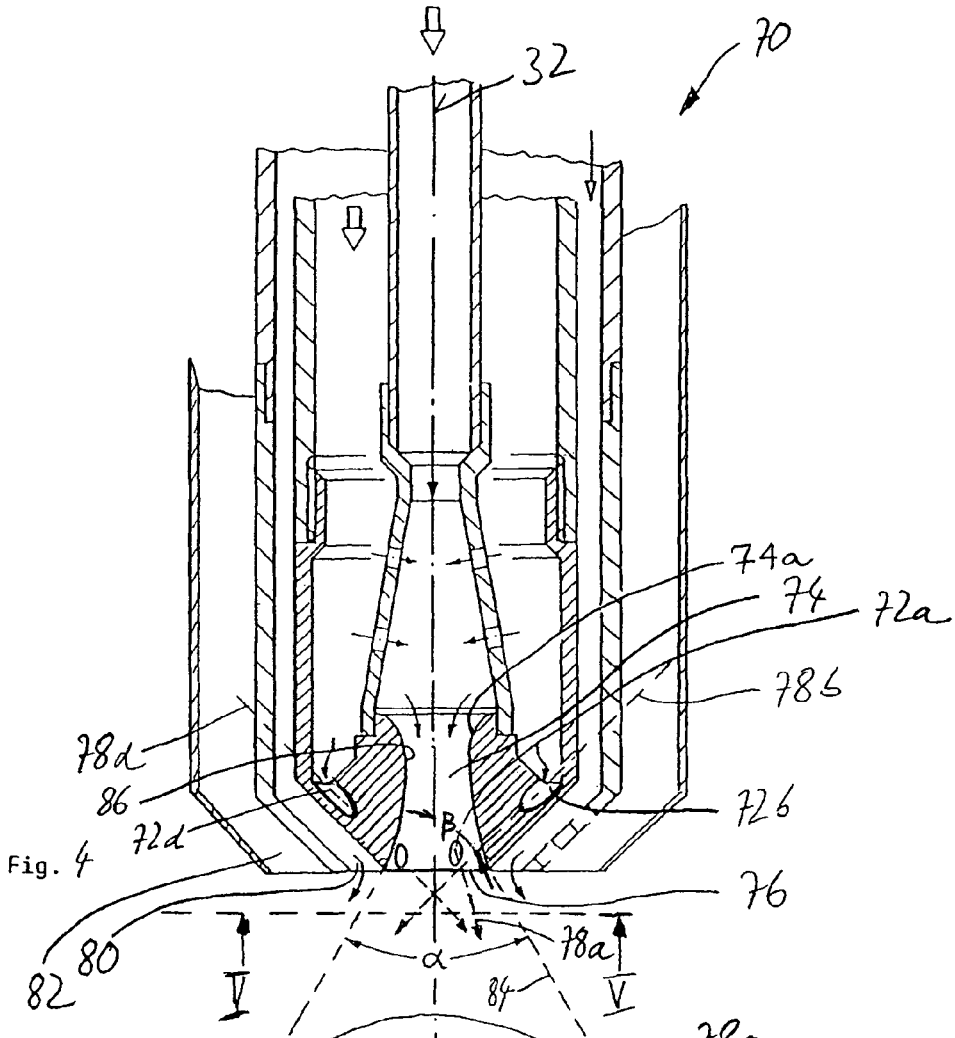
FIG. 4 shows a second embodiment of an inventive two-fluid nozzle.

The sectional view of FIG. 4 shows an inventive two-fluid nozzle 70 according to another embodiment of the invention. Parts with an identical construction to the two-fluid nozzle 30 of FIG. 3 carry the same reference numerals and are not described again.

Unlike in the two-fluid nozzle 30 of FIG. 3, in the case of the two-fluid nozzle 70 there are four secondary air nozzles 72*a*, 72*b*, 72*c* and 72*d*, but in the representation of FIG. 3 only three secondary air nozzles 72*a*, 72*b*, 72*d* can be seen. However, in the view of FIG. 4 it is possible to see the orifices of the four secondary air nozzles 72*a*, 72*b*, 72*c* and 72*d* into an outflow channel 74 of the two-fluid nozzle 70 which defines a main nozzle 74*a*. These orifices are located directly above a nozzle orifice 76. To illustrate the arrangement of the secondary air nozzles 72*a*, 72*b*, 72*c* and 72*d* in each case the median longitudinal axes 78*a* to 78*d* are shown.

FIG. 4 makes it clear that the median longitudinal axes 78*a* to 78*d* of the two-fluid nozzles 72*a* to 72*d* are inclined by angle β to the main nozzle median longitudinal axis 32, as is apparent from FIG. 3. However, additionally the median longitudinal axes 78*a* to 78*d* are skewed to the median longitudinal axis 32 and engage tangentially on a circle arranged concentrically to the main nozzle median longitudinal axis 32. Thus, the secondary air nozzles 72*a* to 72*d* impart an angular momentum on the two-fluid mixture emanating from the outflow channel 74 and consequently ensure a widening of the spray jet to spray angle α. Through the corresponding adaptation of the diameter of the secondary air nozzles 72*a* to 72*d*, it is also possible in this case to ensure that the nozzle holes are in contact or partly overlap at the entrance into outflow channel 74.

Thus, the action lines of the secondary air jets are not directed to the median longitudinal axis 32 of the main jet and are instead immersed in the main jet over a suitable radius r1, which is between 20 and 80% of the main jet radius at the relevant point. The inclination angle β of the median longitudinal axes of the secondary air nozzles 72*a* to 72*d* relative to the main nozzle median longitudinal axis 32 also plays an important part and, as stated, here an angular range between 20 and 80° for the angle β is particularly advantageous.

Thus, the inventive nozzle 30 results from a two-fluid nozzle with annular clearance atomization according to the not previously published German patent application DE 10 2005048 489.1, in that the annular clearance for annular clearance atomization is replaced by a ring of individual air nozzles surrounding the nozzle orifice. As is shown for the two-fluid nozzle 70, an annular clearance atomization with annular clearance 80 can be provided in addition to the ring of the secondary air nozzles 72*a* to 72*d*.

It could be looked upon as a disadvantage of the inventive nozzle that additional energy costs would result from the provision of secondary air. However, it is necessary not to overlook the fact that conventional two-fluid nozzles with a single nozzle orifice produce a very compact, slender droplet jet. In order to be able to implement droplet atomization in a similarly short time or over a comparably short distance as in the case of the novel nozzle, much finer spraying is necessary in the case of the slender nozzle jet. This is naturally also linked with a significant energy cost rise. Competing two-fluid nozzle designs, which in place of a single nozzle orifice have a plurality of nozzle holes, also known as bundle nozzles, and which in this way bring about a large jet opening angle, suffer from the disadvantage that the small exit holes relatively rapidly become clogged, particularly when spraying solid suspensions. In addition, caked deposits occur on the nozzle body between the nozzle holes. Both effects can contribute to a significant atomization disturbance, in that they encourage the formation of large droplets. Moreover, the regulatability of the bundle nozzles is limited and it is relatively difficult to surround the bundle nozzles with barrier or envelope air, which would help to avoid coating formation on the nozzle body between the holes.

Unlike the two-fluid nozzle 30 of FIG. 3, the two-fluid nozzle 70 of FIG. 4 has, in addition to an annular clearance 80 immediately adjacent to the outflow channel 74 and provided for annular clearance atomization to avoid large liquid droplets at the nozzle orifice 76, a screen air nozzle 82 annularly surrounding the annular clearance 80 and which serves to feed in pressure gas at a lower pressure than into the mixing chamber 40 and the annular clearance 80.

Figure 5:
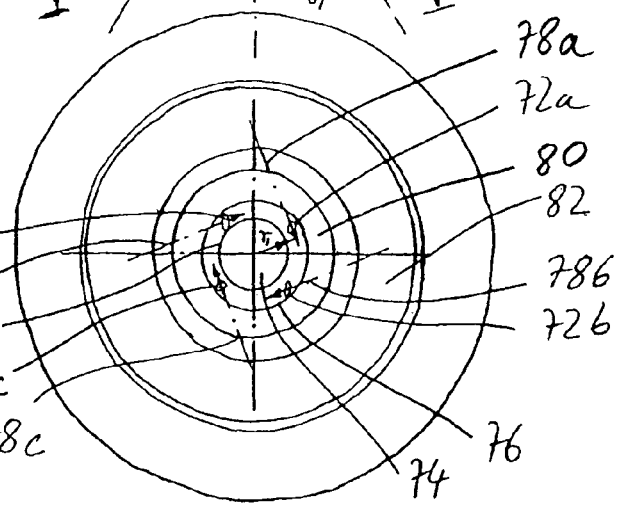
FIG. 5 shows a view of plane V-V of FIG. 4 for illustrating the arrangement of the secondary air nozzles in connection with the two-fluid nozzle of FIG. 4.

FIG. 5 is a view of the two-fluid nozzle 70 from below and roughly level with plane V-V shown in broken line form in FIG. 4. FIG. 5 shows that the median longitudinal axes 78*a* to 78*d* are roughly level with plane V-V and therefore downstream of the nozzle orifice 76, and engage tangentially on an imaginary circle with radius r1. The radius r1 of the circle is approximately 50% of the main nozzle spray jet radius at this point and which in FIG. 4 is defined by the section line of plane V-V and the circumferential surface 84 of the main spray jet. Radius r1 can be between 30 and 80% of the main jet radius at the given point. In other words and as shown in FIG. 3, the radius r1 is between the radius of the nozzle orifice 76 and the radius of a bottleneck 86 in the outflow channel 74. Thus, the median longitudinal axes 78*a* to 78*d* consequently contact an imaginary circular cylinder in tangential manner and which is oriented concentrically to the main nozzle median longitudinal axis 32 and whose radius is between the radius of the nozzle orifice 76 and the radius of the bottleneck 86 in the convergent-divergent-shaped outflow channel 74 of the two-fluid nozzle 70. The contact point of the median longitudinal axes 78*a* to 78*d* with the imaginary circular cylinder can be downstream of the nozzle orifice 76, but in the case of a corresponding nozzle design also level with or even upstream of the nozzle orifice 76.

FIG. 6 shows an inventive two-fluid nozzle 90 with a nozzle body 92, which has a through hole not visible in FIG. 6 and which forms a nozzle orifice 94 on leaving nozzle body 92. As can be seen in FIG. 6 and as will be explained in greater detail hereinafter, the shape of the nozzle orifice 94 is not circular. This is due to the fact that nozzle holes of four secondary air nozzles issue in the vicinity of the nozzle orifice 94.

FIG. 7 shows a side view of the two-fluid nozzle 90 and where additionally broken lines intimate the nozzle holes of the secondary air nozzles. The nozzle holes 96, 98, 100 and 102 are shown in broken line form and are positioned at an angle of approximately 45° to a nozzle median longitudinal axis and issue into an outflow channel 104 in the vicinity of the nozzle orifice 94.

FIG. 8 is a view of the two-fluid nozzle 90 from below, i.e. from the side of the nozzle orifice 94. It is clearly possible to see the four nozzle holes 96, 98, 100 and 102 and their arrangement offset to an intersection of axes through the median longitudinal axis. Thus, the nozzle holes 96, 98, 100 and 102 are arranged tangentially to an imaginary circle about the nozzle median longitudinal axis and do not intersect the latter. FIG. 8 also shows detail D on a larger scale revealing the orifices of the nozzle holes 96, 98, 100 and 102 in the vicinity of the nozzle orifice, the ellipses of detail D intimating the orifice area only being visible if the secondary air nozzle holes 96, 98, 100 and 102 are made in the nozzle body 92 upstream of the outflow channel 74. Detail D reveals that the orifices of the nozzle holes 96, 98, 100 and 102 are in contact and consequently form a ring-like configuration about the two-fluid nozzle median longitudinal axis. In operation the secondary air exiting from the nozzle holes 96, 98, 100 and 102 forms an annular air jet surrounding the spray jet passing out parallel to the median longitudinal axis. It is consequently ensured that a liquid film engaging on the wall of the outflow channel 104 and which is driven towards the nozzle orifice 94 by the flow is engaged over the entire circumference of the outflow channel 104 by secondary air from one of the nozzle holes 96, 98, 100 or 102, is drawn out to form a thin liquid lamella at the nozzle orifice 94 and is atomized in fine droplet form.

FIG. 9 is a sectional view along line A-A of FIG. 7. It is possible to see the central through hole of the nozzle and the secondary air nozzle holes 96, 98, 100 and 102. The nozzle holes 96, 98, 100 and 102 intersect level with the sectional plane A-A in each case with a blind hole 106, the blind holes 106 emanating from an outer circumference of the nozzle, as is also visible in FIG. 6, and are provided for the insertion of constricting screws, so as to be able to adjust a free cross-section of the nozzle holes 96, 98, 100 and 102.

FIG. 10 is a view of the inventive two-fluid nozzle 90 from the side of nozzle orifice 94 and indicates the path of a section line B-B. Section line B-B initially runs centrally through the nozzle hole 102, bends vertically downwards level with the median longitudinal axis, traverses the outflow channel 94 and then, level with the centre of the nozzle hole 98, again bends downwards at right angles.

FIG. 11 is a sectional view along line B-B. The paths of the nozzle holes 102, 98, which initially run parallel to a median longitudinal axis of the two-fluid nozzle 90 are clearly visible and which, after passing in each case through the associated blind hole 106, bend by 45° and ultimately issue into the outflow channel 104 in the vicinity of nozzle orifice 94. Nozzle holes 98, 102 and naturally also the nozzle holes 96, 100 not visible in FIG. 11 emanate from an annulus 108, which is shown in FIG. 12 and which results from the insertion of a mixing chamber component 110 in the nozzle body 92. Into the annulus 108 is introduced pressure gas, which then on the one hand enters a mixing chamber 114 through holes 112 and on the other enters the secondary air nozzle holes 96, 89, 100, 102.

FIG. 12 also shows the opening of the nozzle holes in the vicinity of the nozzle orifice 94 giving the same a shape diverging from the circular cylindrical shape of the outflow channel 104.

Figure 13:
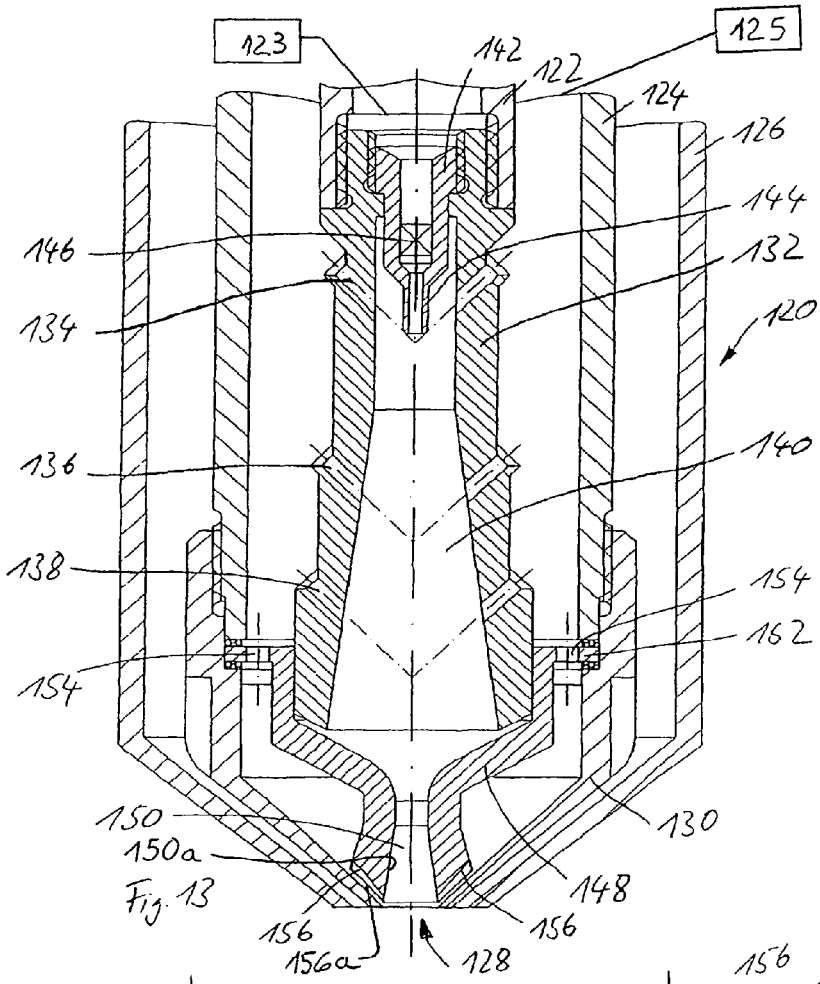
FIG. 13 shows a sectional view of a fourth embodiment of an inventive two-fluid nozzle.

FIG. 13 is a sectional view of an inventive two-fluid nozzle 120 according to a fourth embodiment of the invention. From the manufacturing standpoint the nozzle holes of the two-fluid nozzles 30, 70 and 90 shown in FIGS. 3, 4, 5 and 6 to 12 which are inclined to the nozzle median longitudinal axis are problematical. Thus, for the two-fluid nozzle 120 of FIG. 13 use has been made of another possibility of implementing a ring of secondary air nozzles located in the vicinity of the nozzle orifice.

The two-fluid nozzle 120 has a supply tube 122 through which the liquid to be sprayed is supplied to the nozzle from a liquid supply 123 (shown schematically). Supply tube 122 is surrounded by a concentric pressure gas tube 124, which is in turn concentrically surrounded by a screen air tube 126. Pressure gas is supplied to pressure gas tube 124 from a gas supply 125 (also shown schematically). It has already been stated that the screen air is supplied at a much lower pressure than the pressure gas used for atomization. The pressure of the pressure gas can e.g. be between 1 and 1.5 bar absolute, whereas the supplied screen air would then be supplied e.g. with an absolute pressure of approximately 40 to 80 mbar. Screen air is essentially provided to prevent incrustations close to the nozzle orifice. The pressure gas tube 124 has a truncated cone-shaped component 130 tapering towards a nozzle orifice 128 and also the screen air tube 126 runs in truncated cone-shaped manner towards the nozzle orifice 128 and substantially parallel to the component 130.

The supply tube 122 is extended by means of a mixing chamber component 132 equipped with several pressure gas holes 134, 136, 138. The pressure gas holes 134, 136, 138 are in each case arranged at an angle of approximately 45° to a median longitudinal axis of the nozzle, the pressure gas being introduced as a result of this in the outflow direction into the mixing chamber, and the extensions of the centre axes of the pressure gas holes 134, 136, 138 intersect the median longitudinal axis of the two-fluid nozzle 120.

As is apparent from FIG. 13, in each case there are several, e.g. four uniformly spaced pressure gas holes 134, 136, 138 which are arranged around the circumference of the mixing chamber component 132. Considered in the nozzle outflow direction, there are in all three rings with the pressure gas holes 134, 136, 138 all issuing into a mixing chamber 140. A cross-section of an annular clearance between the pressure gas tube 124 and the mixing chamber component 132 is reduced downstream of each ring of the pressure gas holes 134, 136, 138.

At the transition from the supply tube 122 to the mixing chamber component 132 is provided a liquid nozzle 142, which initially clearly narrows the free cross-section of the supply tube 122 and then has a further cross-sectional reduction and projects with a nozzle tube 144 into the mixing chamber 140. It is optionally possible to provide an angular momentum insert 146 in the liquid nozzle 142. The nozzle tube 144 extends into the mixing chamber 140 to such an extent that the extensions of the pressure gas holes 134 coincide with the end of the nozzle tube 144. The pressure gas entering the mixing chamber 140 through the pressure gas holes 134 ensures that no large liquid droplets can form at the end of the nozzle tube 144 and instead any liquid which may adhere to the edge of the nozzle tube 144 is finely atomized. The provision of the liquid nozzle 142 is specifically advantageous if the inventive two-fluid nozzle 120 is to be used over a large range of a liquid flow to be atomized.

Conventional two-fluid nozzles are generally designed for a narrow liquid flow range. On dropping below the intended liquid flow range, the conventional two-fluid nozzles tend to spit, because at the entrance into the mixing chamber there are no longer stationary flow conditions. Instead the liquid flow entering the mixing chamber migrates out leading to an increased large droplet formation. This is described by the term "spitting".

The liquid nozzle 142 located at the entrance to the mixing chamber 140 is provided for improving the dynamics and control range of the two-fluid nozzle 120. In the case of a low liquid flow, on entering the mixing chamber 140, the liquid tends to drip in a non-stationary manner, which ultimately leads to a non-stationary atomization, i.e. the so-called spitting of the nozzle, and to a poor partial load behaviour. A first measure for obviating this is the provision of the liquid nozzle 142, whose nozzle tube 144 projects into the mixing chamber 140. As the second measure the first ring of the pressure gas holes 134 is so arranged that the liquid passing out of the nozzle tube 144 and without intermediate storage is entrained by the pressure gas provided for atomization purposes. To this end the pressure gas holes 134 are so arranged in the ring of the holes closest to the liquid nozzle 142 on entering the mixing chamber 140 that the entering pressure gas is directed to the opening of the liquid nozzle 142.

The downstream end of the mixing chamber component 132 is axially inserted in an exit component 148, which forms an outflow channel 150 and which extends from the end of the mixing chamber 140 to the nozzle orifice 128. The outflow channel 150 defines a main or primary nozzle 150*a*. Considered in the flow direction, the mixing chamber 140 firstly widens in truncated cone-shaped manner and then at the end of the mixing chamber component 132 narrows again in truncated cone-shaped manner through the exit component 148. The outflow channel 150 connected to the mixing chamber 140 initially narrows, then passes into a circular cylindrical bottleneck and then widens again towards the nozzle orifice 128. Thus, the two-fluid nozzle 120 is constructed as a Laval or convergent-divergent nozzle. At least in the divergent area of the outflow channel 150 the pressure gas-liquid mixture reaches supersonic speed.

At its upstream end the exit component 148 is provided with an annular flange 152 in which are provided in uniformly spaced manner several through holes 154. The annular flange 152 maintains the exit component 148 between the pressure gas tube 124 and the component 130 and with the through holes 154 also ensures that secondary air can enter a gap between the component 130 and the exit component 148. Starting from the gap the pressure gas then flows as so-called secondary air between the component 130 and the downstream end of the exit component 148 and then strikes the spray jet in the vicinity of the nozzle orifice 128 at the downstream end of the outflow channel 150.

As can be gathered from FIG. 13, the exit component 148 and the component 130 are not in contact with one another in the vicinity of the nozzle orifice 128, so that the secondary air can enter the area of the nozzle orifice 128 over the entire circumference of the outflow channel 150 via a continuous annular space 156*a* which extends about nozzle orifice 128. In order to impart an angular momentum on the secondary air exiting in the vicinity of the nozzle orifice 128 and as a result widen the spray jet of the two-fluid nozzle 120, milled slots 156 are provided at the downstream end of the exit component 148. These milled slots 156 in each case form the upper portion of a nozzle channel and can be more clearly seen in FIG. 15. The secondary air passing through between the component 130 and the exit component 148 is consequently channelled and oriented by the milled slots 156 and then strikes the spray jet from the outflow channel 150 in the vicinity of the nozzle orifice 128.

Figure 14:
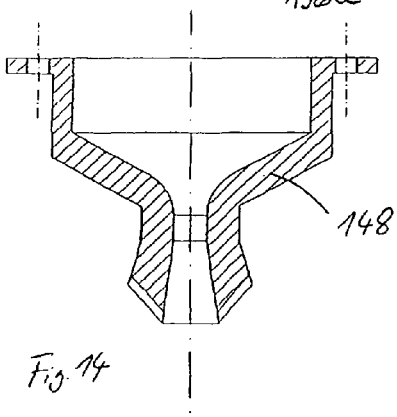
FIG. 14 shows a sectional view of a component defining the outlet of the two-fluid nozzle of FIG. 13.
Figure 15:
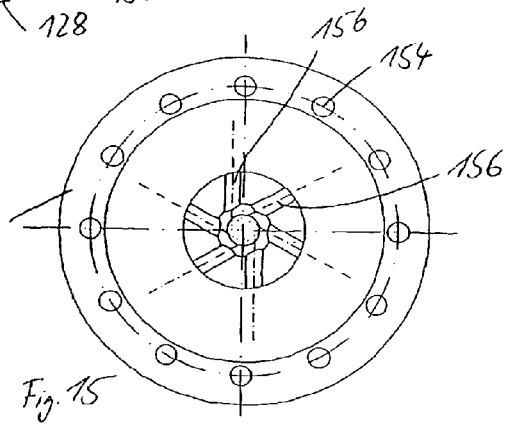
FIG. 15 shows a view from below of the component of FIG. 14.

FIGS. 14 and 15 show the position of the milled slots 156 in a more precise manner. FIG. 15 specifically shows that the median axis of the milled slots 156 is oriented tangentially to an imaginary circle around the median longitudinal axis of the two-fluid nozzle 120. Thus, an angular momentum is imparted to the spray jet at the nozzle orifice 128 and widens. As the exit component 148 is separately manufactured and the nozzle channels by means of the milled slots 156 are only obtained following the insertion of the exit component 148 in the component 130, the manufacture of the two-fluid nozzle 120 is greatly facilitated. Additionally or alternatively to the milled slots 156 in the outflow component 148, the component 130 can also be provided with milled slots forming portions of the nozzle channels. Thus, the inventive two-fluid nozzle 120 has a combination of the nozzle holes issuing at the nozzle orifice 128 with a circumferential annular clearance.

An annular clearance and secondary air nozzle holes or secondary air nozzle channels can consequently be produced by the milled slots 156 on the outside of the conical exit component 148. Additionally or alternatively the annular clearance and secondary air nozzle holes can also be produced by milled slots 156*b* on the inside of the conical outer body, i.e. component 130, as shown in dotted lines in FIG. 14. If the exit part 148 is made to engage on the inside of the component 130, there is no longer a continuous annular clearance and instead there are only discreet nozzle channels.

The production of the slender secondary air nozzle holes in the case of the two-fluid nozzles 30, 70 and 90 is costly and must be carried out using spark erosion. The spark erosion also makes it possible to diverge from cylindrical holes. As opposed to this the milled slots 156 can be made on the exit component 148 using form cutters, e.g. in the form of a rectangular or semicircular groove and this can take place comparatively inexpensively. However, it is also possible to have some other geometry of the milled slots, such as e.g. a wavy design. Through a suitable spacing of the conical outer body, i.e. the component 130, from the central nozzle exit part 148, here again and in a simple manner it is possible to combine an annular clearance and secondary air nozzle holes.

Instead of providing the milled slots 156 in the exit component 148, in the case of a corresponding further development of precision casting methods, the exit component 148 and the conical outer body, i.e. the component 130, can once again be combined into a single, cast component.

The invention claimed is:

1. A two-fluid nozzle defining a fluid flow direction and comprising:

a liquid supply inlet connected to and in communication with a liquid supply;

a main nozzle component defining a longitudinal axis;

a mixing chamber component defining a mixing chamber therein and having an upstream entrance end in communication with said liquid supply inlet and a downstream exit end adjacent to said main nozzle component, the main nozzle component defining an outflow channel downstream of and in communication with the mixing chamber, the liquid supply inlet supplying the mixing chamber with liquid;

a secondary nozzle component disposed in facing relation with said main nozzle component;

a nozzle orifice disposed downstream of the outflow channel and in communication therewith, the nozzle orifice being defined partially by the secondary nozzle component;

air nozzles disposed in an annular manner adjacent said main nozzle component, the air nozzles being formed between said main and secondary nozzle components, the air nozzles being formed by recesses disposed in at least one of the main nozzle component and the secondary nozzle component, the air nozzles being supplied with pressurized gas, the air nozzles being positioned upstream of the nozzle orifice and opening adjacent the outflow channel downstream from the mixing chamber and immediately axially adjacent the nozzle orifice; and a pressurized gas inlet connected to and in communication with a pressurized gas supply, the pressurized gas inlet communicating with the mixing chamber and supplying the mixing chamber with pressurized gas which mixes with liquid in the mixing chamber upstream of the air nozzles;

the upstream entrance end of the mixing chamber having a first diameter and a portion of the mixing chamber between the upstream entrance end and the outflow channel of the main nozzle component having a second diameter, the outflow channel of the main nozzle component having a diameter, the first diameter of the upstream entrance end of the mixing chamber and the diameter of the outflow channel being less than the second diameter of said portion of the mixing chamber.

2. The two-fluid nozzle according to claim 1, wherein a main spraying direction of the air nozzles is directed into a main spray jet emanating from the nozzle orifice.

3. The two-fluid nozzle according to claim 1, wherein median longitudinal axes of the air nozzles are arranged at an angle of 20° to 80° relative to the longitudinal axis of the main nozzle component.

4. The two-fluid nozzle according to claim 1, wherein median longitudinal axes of the air nozzles do not intersect the longitudinal axis of the main nozzle component.

5. The two-fluid nozzle according to claim 1, wherein the air nozzles are oriented tangentially to an imaginary circle concentric to the longitudinal axis of the main nozzle component.

6. The two-fluid nozzle according to claim 5, wherein the imaginary circle has a radius which is between 30% and 80% of a radius of a main spray jet emanating from the nozzle orifice.

7. The two-fluid nozzle according to claim 5, wherein the imaginary circle is disposed downstream of the nozzle orifice.

8. The two-fluid nozzle according to claim 1, wherein the air nozzles issue into the outflow channel downstream from the mixing chamber.

9. The two-fluid nozzle according to claim 1, wherein the air nozzles are in flow connection with a supply line which supplies pressurized gas to the pressurized gas inlet such that the supply line is in flow connection with both the air nozzles and the mixing chamber.

10. The two-fluid nozzle according to claim 1, wherein the air nozzles are connected to an annulus surrounding the mixing chamber.

11. The two-fluid nozzle according to claim 1, wherein the two-fluid nozzle further comprises a screen air tube disposed in surrounding relation with said secondary nozzle component, the nozzle orifice being surrounded by an annular clearance defined between the secondary nozzle component and the screen air tube to which pressurized gas can be supplied.

12. The two-fluid nozzle according to claim 1, wherein, starting from the downstream exit end of the mixing chamber component and in the fluid flow direction of the two-fluid nozzle, the outflow channel initially continuously narrows into a bottleneck and then, starting from the bottleneck, again continuously widens to the nozzle orifice.

13. The two-fluid nozzle according to claim 12, wherein during operation of the two-fluid nozzle, a two-fluid mixture at least portionwise reaches supersonic speed in the outflow channel.

14. The two-fluid nozzle according to claim 1, further comprising a liquid nozzle disposed at the upstream entrance end of the mixing chamber component and in communication with the liquid supply inlet.

15. The two-fluid nozzle according to claim 14, wherein the liquid nozzle has a nozzle tube extending into the mixing chamber.

16. The two-fluid nozzle according to claim 15, comprising pressure gas holes positioned in the mixing chamber component for the introduction of pressurized gas into the mixing chamber from the pressurized gas inlet, the pressure gas holes being positioned in the mixing chamber component to direct pressurized gas onto an end of the nozzle tube.

17. The two-fluid nozzle according to claim 1, wherein the mixing chamber is connected to and in fluid communication with a liquid supply line in communication with the liquid supply inlet and a pressurized gas line in communication with the pressurized gas inlet such that liquid and gas are mixed together within the mixing chamber, and the mixing chamber is disposed upstream of the air nozzles in the fluid flow direction.

18. The two-fluid nozzle according to claim 1, wherein, starting from said upstream entrance end of said mixing chamber component, the mixing chamber has an increasing diameter in the fluid flow direction as the mixing chamber extends in the fluid flow direction towards the outflow channel.

19. The two-fluid nozzle according to claim 1, wherein the main nozzle component and the secondary nozzle component are spaced from one another and are not in contact with one another adjacent the nozzle orifice such that the pressurized gas flowing through the secondary nozzle component enters the nozzle orifice over an entire circumference of the outflow channel.

20. The two-fluid nozzle of claim 1, wherein the main and secondary nozzle components together define the air nozzles.

21. A two-fluid nozzle comprising:

an inlet connected to and in fluid communication with a liquid supply;

a wall defining a mixing chamber in fluid communication with said inlet, said mixing chamber having an upstream entrance end and a downstream exit end, said inlet supplying said mixing chamber with liquid;

a first nozzle component defining a primary nozzle including an outflow channel in fluid communication with said mixing chamber and defining an axis, said outflow channel being disposed downstream of said mixing chamber in a fluid supply direction of said two-fluid nozzle and having a diameter, said mixing chamber having a first diameter at said upstream entrance end thereof and a second diameter at a portion of said mixing chamber between said upstream entrance end and said outflow channel, said first diameter of said mixing chamber and said diameter of said outflow channel both being less than said second diameter of said mixing chamber;

at least one pressurized gas inlet opening into said mixing chamber and being in fluid communication therewith, said pressurized gas inlet being connected to a pressurized gas supply such that pressurized gas flows from said pressurized gas inlet and into said mixing chamber and mixes with liquid in said mixing chamber;

a second nozzle component having a portion disposed in facing relation with said first nozzle component and at least partially defining a nozzle orifice disposed downstream of said outflow channel in the fluid supply direction of said two-fluid nozzle; and a plurality of secondary nozzles disposed in an annular manner about said nozzle orifice, said secondary nozzles being disposed upstream of said nozzle orifice and downstream of said mixing chamber in the fluid supply direction, said secondary nozzles opening immediately axially adjacent said nozzle orifice, said secondary nozzles being disposed between said first nozzle component and said second nozzle component and defined at least partially by recesses disposed in one of said first and second nozzle components, said secondary nozzles being supplied with pressurized gas such that pressurized gas flows through said secondary nozzles and towards said nozzle orifice.

22. The two-fluid nozzle of claim 21, wherein said pressurized gas inlet is disposed in said wall defining said mixing chamber.

23. The two-fluid nozzle of claim 21, wherein said first nozzle component and said second nozzle component are spaced from one another and are not in contact with one another adjacent said nozzle orifice to define a continuous space which extends annularly around a downstream end of said outflow channel to permit pressurized gas flowing through the second nozzle component to enter said nozzle orifice over an entire circumference of said downstream end of said outflow channel.

24. The two-fluid nozzle of claim 21, wherein the first and second nozzle components together define the secondary nozzles.

25. The two-fluid nozzle of claim 21, wherein the secondary nozzles are angularly oriented relative to the axis of the outflow channel.

* * * * *